United States Patent [19]

Miyauchi et al.

[11] Patent Number: 4,668,378

[45] **Date of Patent: * May 26, 1987**

[54] PROCESS FOR THERMAL CRACKING OF HEAVY OIL

[75] Inventors: Terukatsu Miyauchi, Yokohama; Yoneichi Ikeda, Kamakura; Masaharu Tashiro, Yokohama; Osamu Kubota, Chiba, all of Japan

[73] Assignee: Fuji Standard Research Kabushiki Kaisha, Tokyo, Japan

[ * ] Notice: The portion of the term of this patent subsequent to Dec. 25, 2001 has been disclaimed.

[21] Appl. No.: 622,497

[22] Filed: Jun. 20, 1984

[30] Foreign Application Priority Data

May 22, 1984 [JP] Japan ..... 59-103160

[51] Int. Cl.[4] ..... C10G 9/32

[52] U.S. Cl. ..... 208/127; 208/106

[58] Field of Search ..... 208/251 R, 127, 91, 208/159, 106

[56] References Cited

U.S. PATENT DOCUMENTS

| | | | |
|---|---|---|---|
| 2,462,891 | 3/1949 | Noll | 208/91 X |
| 2,506,317 | 5/1950 | Rex | 208/159 |
| 2,755,782 | 7/1956 | Campbell et al. | 208/159 X |
| 3,527,694 | 9/1970 | Luckenbach | 208/118 |
| 3,752,658 | 8/1973 | Blaser | 208/127 |
| 4,055,484 | 10/1977 | Blaser et al. | 208/127 |
| 4,077,869 | 3/1978 | Moritz et al. | 208/127 |
| 4,088,567 | 5/1978 | White | 208/251 R X |
| 4,186,079 | 1/1980 | Roberts | 208/127 |
| 4,243,514 | 1/1981 | Bartholic | 208/91 |
| 4,305,809 | 12/1981 | Chen et al. | 208/127 |
| 4,309,274 | 1/1982 | Bartholic | 208/127 X |
| 4,427,538 | 1/1984 | Bartholic | 208/127 |
| 4,427,539 | 1/1984 | Busch et al. | 208/127 |
| 4,490,243 | 12/1984 | Miyauchi et al. | 208/127 |

FOREIGN PATENT DOCUMENTS

| | | |
|---|---|---|
| 0060618 | 9/1982 | European Pat. Off. . |
| 57-18783 | 1/1982 | Japan . |
| 1280375 | 7/1972 | United Kingdom . |
| 2079777 | 1/1982 | United Kingdom . |

*Primary Examiner*—Glenn Caldarola

*Attorney, Agent, or Firm*—Oblon, Fisher, Spivak, McClelland & Maier

[57] ABSTRACT

An improvement to a process for thermal cracking a heavy hydrocarbon oil comprising (1) a thermal cracking step of the heavy oil which is in contact with a fluidized bed of heated fine particles as a source of the heat required for the thermal cracking and (2) a regeneration step of the fine particles which are withdrawn from the thermal cracking step and on which coke formed during the thermal cracking has deposited, the steps (1) and (2) being practiced while the fine particles are circulated therebetween, is disclosed. The improvement comprises a use as the fine particles of microspheres of a porous material, division of the regeneration step into a gasification section and a combustion section, and restriction in the operation conditions, and an optional temperature control by controlling generation of steam in a cooling means which is installed in the combustion section and whose coolant is water to generate the steam.

10 Claims, 2 Drawing Figures

PROCESS FOR THERMAL CRACKING OF HEAVY OIL

BACKGROUND OF THE INVENTION 1. technical field

This invention relates to a process for thermal cracking of a heavy hydrocarbon oil (hereinafter abbreviated as heavy oil) to obtain primarily light hydrocarbons (hereinafter abbreviated as light oils) which are liquid at room temperature. More particularly, the present invention relates to an improvement of a process comprising a step of thermal cracking in which a heavy oil is contacted with fine particles of a porous material fluidized with a steam-containing gas and a step of regeneration in which the coke deposited on said fine particles withdrawn from the thermal cracking step is removed while the fine particles are fluidized with a molecular oxygen-containing gas or a steam-containing gas, said fine particles being circulated between the both steps.

2. Prior art

Some of the present inventors have previously disclosed that thermal cracking can be practiced under good fluidized state of the bed and wherein with good efficiency when use is made of fine particles comprising particles having a weight average diameter of 0.04 to 0.12 mm and 5 to 50 wt. % of the particles have a diameter of 0.044 mm or less, and they named this process "Fluid Thermal Cracking" (Japanese Laid-Open Patent Publication No. 10587/1981).

They have also disclosed that when use is made of fine particles which have a pore volume of 0.1 to 1.5 $m^3/g$, a specific surface area of 50 to 1500 $m^2/g$ and a weight average diameter of 0.025 to 0.25 mm and are thermally stable, thermal cracking can be practiced at still improved efficiency. They have found that absorption of liquid heavy oil by the pores of the porous material exhibits actions such as promotion of thermal cracking reaction or inhibition of formation of highly carbonaceous solid (hereinafter abbreviated as coke), and they called this "the capacitance effect" (see Japanese Laid-Open Patent Publication No. 18783/1982).

Further, they have disclosed a similar process, comprising a step of thermal cracking a heavy oil and gasification step (this is called a regeneration step in the present invention) for removing by gasification of the coke deposited on the fine particles of the porous material withdrawn from the thermal cracking step by contacting the fine particles with an oxygen-containing gas, while circulating said fine particles between the two steps. Further, an effective embodiment has been shown, in which the fluidized-beds formed in the both steps are arranged adjacent to both sides of a thermally conductive partition wall (see Japanese Laid-Open Patent Publication No. 158291/1982).

Whereas, concerning the process performing circulation of particles between the thermal cracking step and the regeneration step, there is a number of examples of practice and patents. In the fluid catalytic cracking process (FCC process) intended primarily for obtaining gasoline from light oil, each of the catalytic cracking step and the regeneration step is conducted according to the fluidized-bed reaction system, simultaneously with circulation of a relatively large amount of catalyst particles. On the other hand, in the fluid coking gasification process (hereinafter abbreviated as Flexicoking process), the coke particles formed are generally circulated between the thermal cracking step and the regeneration step comprising a combustion section and a gasification section, and further a heating section is added to the process, if desired. According to the Flexicoking process, the coke particles heated to high temperature at the combustion section are circulated, while being apportioned to the thermal cracking step and the gasification step, respectively, and the reaction heat necessary for the respective sections is supplied through the sensible heat thereof (see Japanese Laid-Open Patent Publication No. 108193/1982). Further, according to the Flexicoking process, there is a system in which the heat necessary for thermal cracking is supplied by circulation of the coke particles between the thermal cracking step and the gasification step, and the heat necessary for the gasification reaction is supplied by the heat of the coke particles circulated between the gasification step and the combustion step (see Japanese Laid-Open Patent Publication No. 76090/1982).

Each of such prior art is useful, but its practical usefulness would be further improved if the operational control could be done more easily.

SUMMARY OF THE INVENTION

The present invention is concerned with an improvement of the prior invention by some of the present inventors.

More specifically, an improved process for thermal cracking of a heavy oil in accordance with the present invention comprises a thermal cracking step of a heavy oil by contacting the heavy oil with fine particles of a porous material fluidized by a steam-containing gas and a regeneration step of the fine particles withdrawn from the cracking step, when the fine particles are being fluidized, by removing by combustion or gasification of the coke deposited on the fine particles with a molecular oxygen-containing gas or a steam-containing gas, said steps being practiced while the fine particles being circulated between the both steps, wherein the improvement comprises carrying out these steps under the conditions as shown below:

(1) said fine particles are of a porous material constituted essentially of fine spherical particles having a pore volume of 0.2 to 1.5 $cm^3/g$, a specific surface area of 5 to 1,500 $m^2/g$, an average pore diameter of 10 to 10,000 Å and a weight average particle diameter of 0.025 to 0.25 mm, these properties being stable at the temperature employed;

(2) said regeneration step comprises a combustion section and a gasification section from which the gases generated in the respective sections can be taken out separately and between which said fine particles are circulated;

(3) the temperature of the combustion section is controlled by controlling an amount of steam generated in a cooling means which is installed in the combustion section in the regeneration step and through which water is passed for cooling the combustion section;

(4) at least 70% by weight of said fine particles circulated between the thermal cracking step and the regeneration step are circulated between the thermal cracking step and the gasification section in the regeneration step;

(5) the amount of said fine particles circulated between the combustion section and the gasification section in the regeneration step is at least 20-fold weight of the CCR of the heavy oil fed;

(6) said fine particles contact a molecular oxygen-containing gas at the combustion section in the regeneration step whereby a part of the coke deposited is combusted, whereby the temperature of said fine particles is higher by at least 50° C. than the temperature in the gasification section;

(7) said fine particles contact a steam-containing gas at the gasification section in the regeneration step thereby gasifying a part of the coke deposited thereon, whereby the temperature of said fine particles is higher by at least 100° C. than the temperature in the thermal cracking step; the condition (3) being optional.

In the present invention, by the use of fine particles of a porous material and by dividing the regeneration step into the two sections of the gasification section and the combustion section and, optionally, controlling the temperature at the combustion section by controlling an amount of steam generated in a cooling means installed in the combustion section, advantages can be enjoyed.

First, by the use of fine particles of a porous material, several advantages can be obtained due to the development of a uniform and smooth fluidized state. This fluidized state is attributed to the deposition of coke not on the surface of the particle but within their pores. The primary points of these advantages are enumerated below:

(a) attrition of the fine particles or abrasion of the apparatus is negligible;

(b) operations such as fluidization, circulation and transportation of particles is facilitated.

(c) thermal cracking reaction can proceed at a relatively lower temperature, with the coke deposited and gases produced in the cracking being small in amount, and the yield of lighter oil is high; and (d) the regeneration reaction can proceed at a relatively lower temperature.

On the other hand, the primary advantages obtained from the use of the regeneration step divided into a gasification section and a combustion section are as follows:

(e) a gas product of high quality suitable as a material for synthesis can be obtained from the gasification section;

(f) the amount of oxygen supplied to the gasification section can be markedly reduced or made nil; and (g) since the combustion section can be maintained under substantially complete combustion state, a maximum amount of heat possible can be generated.

Further, the primary advantages obtained by optionally providing a cooling means at the combustion section in the regeneration step and controlling the temperature of the combustion section are as follows:

(h) by controlling the heat recovered at the cooling means, the temperature control of the thermal cracking process as a whole can be practiced very easily; and (i) in particular, when water is used in accordance with the present invention as the coolant for the cooling means, more than half of the steam consumed in the thermal cracking step and the gasification section can be supplied by the steam generated.

DETAILED DESCRIPTION OF THE INVENTION

Basic process

Figure 1:
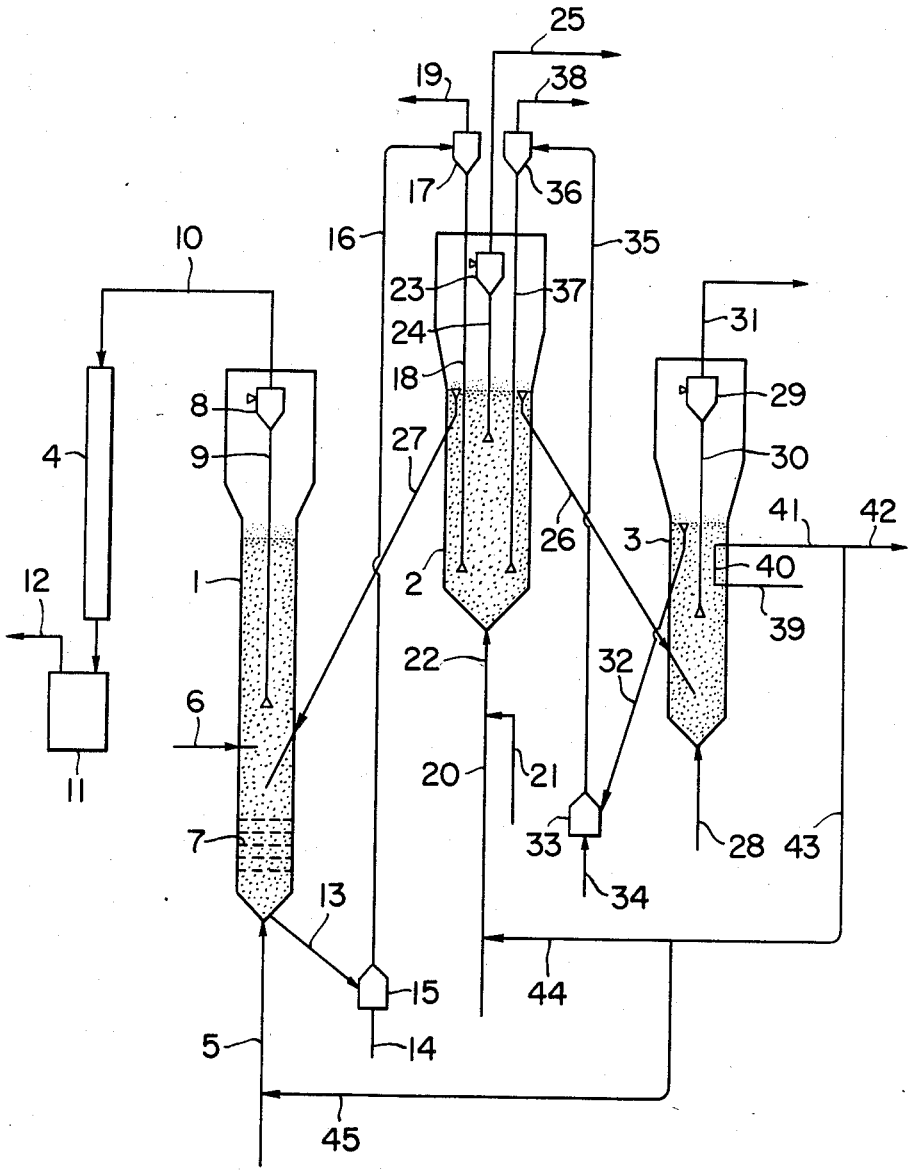
FIG. 1 is a flow chart showing one embodiment of the present invention with a cooling means installed in the combustion section.

The basic process in the present invention comprises a thermal cracking step in which a heavy oil is contacted with a fluidized bed of porous fine particles and a regeneration step in which the fine particles withdrawn from the cracking step are regenerated, both steps being carried out so that, said fine particles are circulated therebetween. At the same time the regeneration step comprising gasification of the coke deposited on the fine particles with steam and combustion of the coke with molecular oxygen, optionally with temperature control by a cooling means, permits the gas produced by the gasification and the gas produced by the combustion to be recovered separately from each other.

The present invention is further characterized in that the basic process is operated under optimized conditions.

DIFFERENCE FROM THE PRIOR INVENTIONS

The present invention employs the same fine particles of porous material as in the prior invention by some of the present inventors as mentioned above, but differ therefrom in the mode of practice. The present invention also differs from the FCC process in that the latter is a catalytic cracking with the use of a catalyst and also in the mode of practice. Further, the present invention differs from an example of the Flexicoking process in that the latter employs cokes with relatively coarse particles as the circulating particles as well as in the mode of practice and object.

More specifically, in the present invention, fine particles of a porous material is employed similarly as in the prior invention by some of the present inventors. The fine particles are required to be of a porous material constituted essentially of fine spherical particles having a pore volume of 0.2 to 1.5 $cm^3/g$, a specific surface area of 5 to 1,500 $m^2/g$, an average pore diameter of 10 to 10,000 U and a weight average particle diameter of 0.025 to 0.25 mm, and these properties are also required to be stable at the temperature employed. The values of these properties are slightly limited in the ranges as compared with those specified in said prior inventions, and they have been determined for practicing effectively the present invention.

In the present invention, the regeneration step comprises a combustion section and a gasification section. These sections are required to be capable of removing the gases generated in respective sections separately from each other, while simultaneously permitting said fine particles to be circulated therebetween. According to such a regeneration step, a gas produced by the combustion of a low quality with a small amount of heat generation and a gas produced by the gasification of a high quality with much amount of heat generation can be obtained separately. Such a system itself has also been practiced in the prior art in the Flexicoking process as mentioned above or others, but no application of such a system for a fluidized bed of a fine particles of a porous material as in the present invention has been found to the best of the knowledge of the present inventors.

Optionally, in the present invention, the temperature control of the combustion section is conducted by providing a cooling means installed within the combustion section in the regeneration step. In accordance with the present invention, water is introduced as the coolant for the cooling means thereby generating steam, and more than half of the steam necessary in the thermal cracking step and the gasification section in the regeneration step can thereby be supplied by the steam thus generated. Besides, since less valuable coke deposited is used as a fuel combusted at the combustion section in the regenerating step, steam can be produced at a low cost, the use of inexpensive air as the molecular oxygen-containing gas adding further to the economy.

The most salient feature of the present invention resides in provision of a cooling means at the combustion section in the regeneration step, whereby there is the advantage of practicing the temperature control of the thermal cracking process as a whole very easily, as mentioned above.

First, for practicing the thermal cracking reaction while maintaining the conditions such as the amounts of the feedstock heavy oil and steam fed, the pre-heating temperature and the thermal cracking temperature at desired values, the heat necessary for thermal cracking is required to be supplied through the heat content of the fine particles circulated from the regeneration step to the thermal cracking step, and for this purpose, the amount and the temperature of the fine particles circulated from the gasification section in the regeneration step to the thermal cracking step are required to be maintained at desired values.

Next, for practicing the gasification reaction while maintaining the amount of the fine particles circulated from the gasification section in the regeneration step to the thermal cracking step and the temperature at desired values and also maintaining the amount of the steam- or the molecular oxygen-containing gas which is optionally fed and the conditions such as pre-heating temperature, etc. at desired values, it is required to supply heat necessary for gasification by the heat content in the fine particles from the combustion section to the gasification section, and for this purpose, it is necessary to maintain the amount and the temperature of the fine particles circulated from the combustion section in the regeneration step to the gasification step at desired values.

Accordingly, in the combustion section of the regeneration step, it is required to maintain the amount of the coke combusted, while maintaining the amount and the temperature of the fine particles circulated from the combustion section to the gasification section. Among these conditions, the amount of the coke combusted can be controlled approximately by controlling the amount of the molecular oxygen-containing gas supplied to the combustion section, but it is considerably difficult to maintain both the amount and the temperature of the molecular oxygen-containing gas at desired values at the same time.

However, in the present invention, the various conditions in the combustion section as mentioned above can be maintained very easily by controlling the heat content to be removed from the combustion section out of the system by operating a cooling means in which water is used as a coolant and the amount of steam generated is controlled. In other words, in the present invention, the temperature control of the thermal cracking process can easily be done only by controlling the quantity of heat removed by the cooling means at the combustion section without alteration of other conditions. Controlling of the quantity of the heat removed from the combustion section by the cooling means is easily practiced by generating steam by use of water as the coolant, changing the temperature or the amount of the cooling water, and the heat transfer area for passage of water (e.g. number of tubes for passing water).

In the present invention, at least 70% by weight of the amount of the fine particles circulated between the thermal cracking step and the regeneration step is required to be circulated between the thermal cracking step and the gasification section of the regeneration step. According to such a system, the fine particles reach the gasification section under the state with a coke deposited thereon by the thermal cracking, which coke is rich in relatively volatile components and readily gasifiable, and therefore the gasification reaction with the fluidizing gas can proceed more readily to give a gas of relatively higher quality. In circulation of the fine particles between the thermal cracking step and the regeneration step, the total amount should preferably be circulated between the thermal cracking step and the gasification section of the regeneration step, but circulation in an amount up to 30% by weight of the total amount may be permissible between the thermal cracking step and the combustion section of the regeneration step.

In the present invention, the amount of the fine particles present between the combustion section and the gasification section in the regeneration step is required to be at least 20-fold weight of the CCR of the heavy oil fed (preferably at least 40-fold weight). In the present invention, an amount substantially equal to the CCR in the heavy oil is deposited on the fine particles (more specifically, deposited in the pores), and a part thereof is gasified in the gasification section, with the remainder being combusted at the combustion section with a fluidizing gas used therein. According to such a system, the fine particles elevated in temperature is circulated in a large amount between the combustion section and the gasification section, whereby the heat quantity necessary for gasification reaction is supplied from the combustion section by the sensible heat of the fine particles. In the present invention, thanks to an improved fluid characteristic of the fine particles, the amount of the particles circulated between the combustion section and the gasification section can easily be increased, with the result that the temperature difference between the combustion section and the gasification section can be made smaller.

In the present invention, it is required that a part of the coke deposited be combusted through contact of the fine particles with a molecular oxygen-containing gas at the combustion section in the regeneration step, and the temperature of the fine particles be higher by at least 50° C. than the temperature of the gasification section. The temperature difference of 50° C. or higher between the combusion section and the gasification section is important for sufficient progress of the combustion and further for efficient transfer of heat therebetween.

In the present invention, combustion of a part of the coke deposited on the fine particles at the combustion section reduces the amount of the coke to be gasified at the gasification section and thus results in reduction of the amounts of the molecular oxygen-containing gas and the gas produced. Accordingly, when employing pure oxygen as the molecular oxygen-containing gas for the gasification, its amount of consumption can be reduced.

In the present invention, it is required that a part of the coke deposited be gasified through contact of the fine particles with a steam-containing gas at the gasification section in the regeneration step, and the temperature of the fine particles be higher by at least 100° C. than the temperature in the thermal cracking step. That the temperature at the gasification section is to be higher by at least 100° C. than the temperature of the thermal cracking step is important for sufficient progress of the gasification reaction and further for efficient heat transfer therebetween.

According to an embodiment of the present invention, the fine particles can be transported from the regeneration step to the thermal cracking step with steam or steam-containing gas and a part or whole of the heavy oil can be fed into the stream of the fluidized fine particles during transportation at high speed to be contacted therewith, whereby a part of the thermal cracking reaction can take place. Alternatively, according to another embodiment of the present invention, the fluidized fine particles can be transported with a molecular oxygen-containing gas and a part of the coke deposited on the particles can be combusted during transportation thereof at high speed.

Feedstock heavy oil

The "heavy oil" as mentioned in the present invention means a hydrocarbon, which is usually a mixture, having a CCR value of 3 or higher, and includes those which are solid at normal temperature.

The heavy oil as a feedstock which can enjoy well the effect of the present invention is one having a relatively large amount of CCR, for example, about 5 or higher, preferably about 10 or higher. Examples of suitable feedstock heavy oil are heavy crude oil, a residue obtained by atmospheric distillation of a crude oil (hereinafter referred to merely as atmospheric residue), a residue similarly obtained by vacuum distillation of a crude oil (hereinafter called merely as vacuum residue), deasphalted oil, kerogen shale oil, tar sand oil, liquefied coal oil and the like.

Fine particles

The fine particles to be used in the present invention are as defined above.

Examples of the fine particles suitable for the present invention include those for use as carriers for fluidized-bed catalyst of an alumina type and a silica type, spent and deteriorated catalysts of a silica-alumina type used in the FCC method, spent or deteriorated catalysts of an aluminosilicate zeolite type, some types of spherical activated charcoal, and mixtures thereof. However, these are not limitative of the present inventions, but other materials can be available, insofar as they have the properties as specified above. Besides, it is not required at all that the fine particles should have a catalytic activity on the cracking reaction of a heavy oil.

Among these, particularly preferred is a material of an alumina type conventionally used as a carrier for fluidized-bed catalyst. This is excellent in heat resistance and the changes in the particle properties during usage are very little.

The "pore voluxe" of the fine particles as mentioned in the present invention refers to the total volume of the pores contained in the porous material of a unit weight, and it can be determined usually by boiling a porous material in a liquid, taking out the material and dividing the weight gain as measured when its surface has been just dried by the specific gravity of the liquid used.

Thermal cracking step

The reactor for thermal cracking is a vertical vessel for containing a fluidized-bed of fine particles, usually a longitudinal cylinder. At the bottom end of the reactor is an inlet for feeding a steam-containing gas, at the middle portion an inlet for feeding a feedstock oil and at the upper end a discharging outlet for the products of the thermal cracking via recovery equipments for entrained particles such as a cyclone or a dip-leg. The reactor is also provided with an inlet primarily for the particles circulated from the regeneration step and an outlet primarily for the particles circulated to the regeneration step. The reactor may also be equipped conveniently with inserts such as heat exchangers or perforated plates.

The temperature of the fluidized-bed for carrying out thermal cracking may be suitably about 350° to 600° C. The preferable temperature range is from 400° to 550° C. and the yield of the oil produced is at its maximum within this temperature range. It is preferred to pre-heat the feedstock oil or a steam-containing gas before feeding it into the reactor. The "steam-containing gas" to be introduced in order to carry out thermal cracking, while maintaining the mass of the fine particles at a fluidized state, may be generally pure steam from a steam generating unit. However, since water is used as the coolant for the cooling means at the combustion section in the regeneration step, the steam generated at the cooling means is employed, with pure steam being supplemented in shortage thereof. It is also possible to use a mixture of steam of these types with carbon dioxide, carbon monooxide, hydrogen, hydrocarbon, nitrogen and a mixture thereof. The amount of steam fed may be 1 to 100% by weight, preferably 5 to 50% by weight, as pure steam based on the heavy oil fed. At a level lower than the lower limit, the yield of the oil produced will be lowered, while a level higher than the upper limit is not economical.

The amount of the fine particles circulated from the regeneration step to the thermal cracking step depends approximately on the amount of the heavy oil fed for thermal cracking. More specifically, it is preferred that the pore volume of the regenerated fine particles and the fresh or virgin fine particles optionally added (the position for addition may be in the thermal cracking reactor, the regenerator or any other desired site) should be equal to or larger than the volume of the heavy oil fed. If the pore volume of the fine particles is less than the volume of the heavy oil, a bogging phenomenon tends to occur. The "volume of the heavy oil fed" as herein mentioned is meant to define a value which is obtained by dividing the amount of the heavy oil fed (weight) by its density at the feeding temperature. To show such a correlation in weight basis, the amount of the fine particles circulated between the thermal cracking step and the regeneration step should desirably be about 0.5 to 10-fold weight, preferably 1 to 5-fold weight relative to the amount of the heavy oil fed. And, 70% by weight or more of the amount of the fine particles circulated between the thermal cracking step and the regeneration step must be circulated between the thermal cracking step and the gasification section in the regeneration step.

The ascending speed of the gaseous components in the fluidized-bed is ordinarily 5 to 160 cm/sec. in terms of "a superficial velocity in a column", preferably about 10 to 80 cm/sec. for obtaining the optimum fluidized state. The pressure is not particularly limited, but generally from atmospheric pressure to about 10 kg/cm$^2$.

Products of the thermal crackinq

The product oils obtained from the thermal cracking step of the present invention are liquid at normal temperature consisting of, for example, the naphtha fraction (b.p. lower than 170° C.), kerosene fraction (b.p. 170°-340° C.), light oil fraction (b.p. 340°-540° C.) and heavy oil fraction (b.p. higher than 540° C.). The product oil is smaller in amount of the naphtha fraction as different from the catalytic cracking of the prior art and rich in the intermediate fractions such as kerosene fraction and the light oil fraction, because the process of the present invention is based on the thermal cracking reaction. Also, the heavy oil fraction is very small in amount. Other than such liquid oils at normal temperature, a small amount of gas capable of heat generation of about 5,000-10,000 kcal/$Nm^3$ is generated.

Regeneration step

The regeneration reactor comprises the gasification section and the combustion section, and the combustion section is optionally provided with a cooling means for temperature control. As described above, the gasification section and the combustion section are so constructed as to be capable of removing the gases generated in respective sections separately from each other, and the fine particles processed there is circulatable between the respective sections. For this purpose, both sections may be constructed as separate units and piping may be arranged so as to circulate the fine particles therebetween, or both sections can be constructed to be housed in a single unit. The fine particles from the thermal cracking step may be introduced first into the combustion section or first to the gasification section or simultaneously to both sections, respectively. Since the combustion rate of the coke deposited is much higher than its gasification rate, it is advantageous to introduce the fine particles from the thermal cracking step into the gasification section, thereby maintaining the level of the coke deposited at the gasification section higher, and then delivering the fine particles to the combustion section for combustion of the remainder of the coke deposited, whereby the gasification reaction rate can be maintained high and the contents of carbon monooxide and hydrogen can also be maintained high. The fine particles from the combustion section may be delivered as such to the thermal cracking step, but it is more advantageous to deliver it via the gasification section to the thermal cracking step. This is because the fine particles enter the thermal cracking after having passed once through a reducing atmosphere which can render heavy metals precipitated thereon (particularly compounds of nickel, vanadium, etc.), particularly when such metals are contained in the feed stock in large amounts, to reduced state, thereby alleviating markedly deleterious effects by such heavy metals on the thermal cracking reaction.

Therefore, in the present invention, at least 70% by weight of the amount of the fine particles circulated between the thermal cracking step and the regeneration step is circulated between the thermal cracking step and the gasification section of the regeneration step. Up to 30% by weight of the amount of the fine particles circulated between the thermal cracking step and the regeneration step may be circulated between the thermal cracking step and the combustion step of the regeneration step.

Also, in the present invention, by delivering the fine particles from the gasification section to the combustion section, the coke level on the fine particles can be lowered and therefore the combustion reaction can proceed substantially completely to lower markedly the contents of carbon monooxide and hydrogen in the gas produced by the combustion. It is also possible to combust or burn secondarily residual carbon monooxide and hydrogen in the gas produced by the combustion completely by further supplying a molecular oxygen-containing gas, particularly air, into the gas produced by the combustion left from the fluidized fine particles in the combustion section.

According to a preferred embodiment, each of the combustion section and the gasification section comprises a vertical vessel containing fluidized-bed of fine particles, usually a longitudinal cylindrical column. Particularly, the vertical combustion section can be markedly long. At the lower end of the reactor of the gasification section is equipped an inlet for feeding steam or steam-containing gas, at the upper end an outlet for discharging the product gas through a cyclone, a dip-leg, etc., and inlets for introducing particles circulated from the thermal cracking step and the regeneration step and discharging outlets to the respective steps. The reactor may also be provided internally with inserts such as heat exchangers or perforated plates, as desired.

The temperature of the fluidized-bed for carrying out the gasification reaction may be about 650° to 950° C., preferably 700° to 900° C. At a temperature lower than the range, the progress of the gasification reaction will be insufficient, while a temperature higher than the range is not only unnecessary, but also the temperature of the combustion section will be higher than that temperature, whereby there is a possibility of thermal degradation of the fine particles employed.

The steam-containing gas, which is introduced for the purpose of promoting the gasification reaction while maintaining the mass of the fine particles at a fluidized state, should preferably be pre-heated before being fed into the reactor. The "steam-containing gas" to be utilized in the present invention may be usually pure steam from a steam generating unit, but, since water is employed as the coolant for the cooling means when such is desired, the steam generated in the cooling means may be employed, with the shortage being supplemented with pure steam. It is also possible to use a mixture of the steam with carbon dioxide, carbon monooxide, hydrogen, hydrocarbon, nitrogen or a mixture thereof. Further, by mixing oxygen or air therewith, the temperature of the combustion section can be lowered and the amount of the particles circulated to the combustion section can be reduced to make the operation easier. The amount of the molecular oxygen fed may be 50% by weight, preferably 25% by weight, of the steam fed. The ascending speed of the gaseous components in the fluidized-bed may be about 5 to 160 cm/sec., preferably 10 to 80 cm/sec as superficial velocity. The pressure is not particularly limited, but usually from atmospheric to about 10 kg/$cm^2$.

On the other hand, at the lower end of the combustion section is equipped an inlet for feeding the molecular oxygen-containing gas, at the upper end an outlet for discharging combusted gas through a cyclone and a dip-leg, etc. and the inlet and the outlet primarily for inflow or discharging of the particles circulated from or to the gasification section. The reactor may also be provided internally with inserts such as heat exchangers or perforated plates, as desired.

The combustion section is also provided in the zone of the fluidized-bed of the fine particles with a cooling means if so desired, namely a group of heat transfer tubes through which a coolant, namely water, is passed. If desired, another cooling means is also installed in the secondary combustion zone of the gas produced by the combustion.

The temperature of the fluidized-bed for carrying out the combustion reaction should preferably be about 700° to 1,000° C., preferably 750° to 950° C. At a temperature lower than the range, not only the progress of the combustion reaction is insufficient, but also the heat generated by combustion cannot be transferred effectively to the gasification section. On the contrary, a higher temperature may cause thermal degradation in the properties of the fine particles employed.

As the molecular oxygen-containing gas to be introduced for promoting the combustion reaction while maintaining the mass of the fine particles at a fluidized state, pre-heated air is usually employed. The air can be mixed with hydrocarbon, carbon monooxide, hydrogen, steam, oxygen, etc. The combustion reaction in the fluidized bed can proceed more readily as compared with the gasification reaction, and therefore the ascending speed of the gaseous components in the fluidized-bed (superficial velocity) can be increased markedly higher than the gasification reaction, to usually about 15 to 1,500 cm/sec., preferably 20 to 1,000 cm/sec. Within the range of from about 15 to 200 cm/sec., an ordinary fluidized state (thick fluidized-layer) is exhibited, but the particle density of the fluidized-bed becomes small, namely in the state of so called dilute fluidized-bed, at a velocity of 200 cm/sec. or higher. When employing such a dilute fluidized-bed, it is not required to provide a specific device of a combustion section, but the pipe for circulation of the particles between the thermal cracking step and the gasification section can be utilized as the combustion section.

A surplus of heat generated at the combustion section is removed by a cooling means which may comprise heat transfer tubes arranged vertically, horizontally or in a coil, as desired, within the combustion section, preferably a heat transfer pipe through which water is passed, to generate steam. The system for generation of steam may be a conventional one generally adopted for fluidized-bed boiler, etc.

The amount of the particles circulated between the gasification section and the combustion section in the regeneration step is determined depending on the conditions as described above, but generally 1-fold weight or more of the heavy oil fed, preferably 5-fold weight or more.

The gases produced in the regeneration step

In the regeneration step, the gas produced by the combustion is obtained from the combustion section and the gas produced by the gasification is obtained from the gasification section.

In the combustion section, air is usually used as the oxygen-containing gas and the gas produced is rich in nitrogen and carbon dioxide, with a small content of carbon monooxide or hydrogen, and the gas obtained is a gas capable of heat generation in a low amount of about 500 kcal/Nm$^3$.

In the gasification reaction, a steam-containing gas is employed. The "steam-containing gas" employed here may be a steam to which oxygen or air is added. When only steam is employed, a gas capable of high heat generation in an amount of about 2,000 kcal/Nm$^3$ or more rich in hydrogen and carbon monooxide can be obtained. When oxygen or air is employed together with steam, the quality of the gas produced is lowered, but the amount of heat necessary for gasification reaction can be reduced, whereby the amount of heat transfer through the circulated particles from the combustion section can be reduced to result in the advantageous lowering of the temperature of the combustion section as well as reduction in amount of the particles circulated. When a mixture of steam and air is employed, it is also possible to obtain a product gas having a composition containing nitrogen suitable for ammonia synthesis.

Flow chart

FIG. 1 is an example of the flow chart for practicing the present invention with the optional cooling means.

In FIG. 1, an apparatus 1 is a thermal cracking reactor for thermal cracking of a heavy oil, an apparatus 2 is a gasification reactor corresponding to the gasification section for removal by gasification of the coke deposited on the fine particles formed during the thermal cracking, an apparatus 3 is a combustion reactor corresponding to the combustion section for removal by combustion of the coke deposited on the particles. An apparatus 4 is a cooler for separating the product formed by cracking into the oil and the gas produced.

Into the thermal cracking reactor 1 is fed from the bottom portion steam or a steam-containing gas through a conduit 5, and the feedstock heavy oil is fed alone or together with steam from the conduit 6. The fine particles filled in the thermal cracking reactor are fluidized by feeding of the above materials, and thermal cracking reaction proceeds primarily at the position upper than the position where the feedstock heavy oil is fed, while the oil produced is held within the pores of the fine particles subjected to stripping at the position lower than said position, while descending in a fluidized state through the perforated plate 7.

The product produced by the thermal cracking is removed of the fine particles accompanied therewith by means of the cyclone 8 and the dip-leg 9 provided at the top of the reactor and, passing through the conduit 10, reaches the cooler.

The condensed liquid product, namely the product oil, is separated in a reservoir 11 and the uncondensed gas, namely the gas produced by the thermal cracking is removed out of the system via the conduit 12.

The fine particles having coke deposited thereon as the result of thermal cracking is discharged from the conduit 16 at the bottom and delivered by the ejector 15 with a gas such as nitrogen or steam from the conduit 14, passing through the conduit 16, via the cyclone 17 and the dip-leg 18, to the gasification reactor, and the gas such as nitrogen or steam is discharged out of the system through the conduit 19.

The steam-containing gas from the conduit 20 and the molecular oxygen-containing gas are mixed and fed via the conduit 22 to the bottom of the gasification reactor. The fine particles having coke deposited thereon delivered from the thermal cracking reactor and filled in the gasification reactor is fluidized with the gas fed from the conduit 22 and a part of the coke deposited is gasified. The product gas is removed from the accompanying fine particles by the cyclone 23 and the dip-leg 24 provided at the top of the gasification reactor and taken out of the system through the conduit 25. A part of the fine particles subjected to the gasification reaction is delivered through the overflow pipe 26 to the combustion reactor and the remainder circulated through the overflow pipe 27 to the thermal cracking reactor.

The fine particles delivered from the gasification reactor and filled in the combustion reactor (having remainder of the coke deposited) is fluidized with a molecular oxygen-containing gas of air or others from the conduit 28 to remove the remainder of the coke by combustion. The gas produced is removed of the accompanying fine particles by means of the cyclone 29 and the dip-leg 30, and taken out of the system through the conduit 31. The fine particles from the combustion section pass through the overflow pipe 34 to reach the ejector 33, and circulated by the gas such as nitrogen or steam through the conduit 35, via the cyclon 36 and the dip-leg 37, and the gas such as nitrogen or steam is discharged out of the system through the conduit 38.

Also, water is introduced from the conduit 39 into the heat transfer piping of the cooling means, wherein it is converted into steam and taken out from the conduit 41. This steam is discharged passing through the conduit 42 and discharged out of the system passing through the conduit 42, or via the conduits 43, passing through the conduit 44 and/or the conduit 45, enters the conduit 20 and/or the conduit 5 and is then led to the gasification reactor and/or the thermal cracking reactor.

Figure 2:
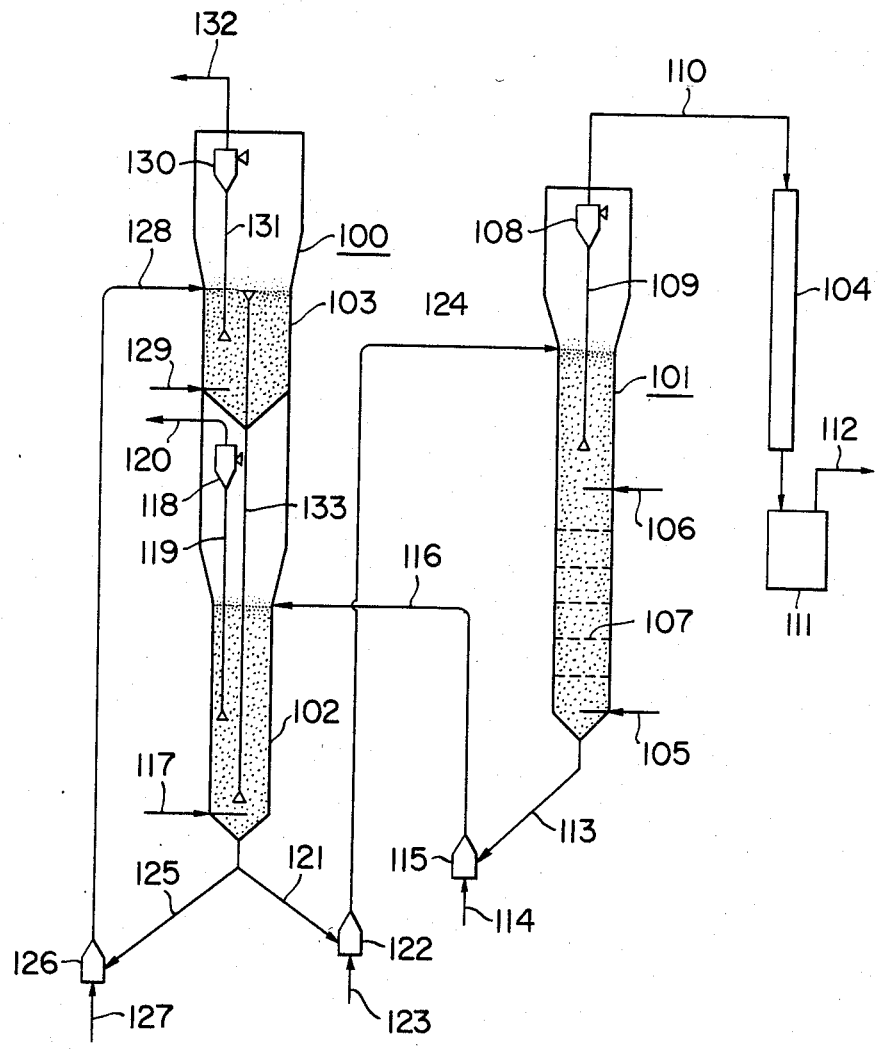
FIG. 2 shows another embodiment which has no such cooling means installed.

FIG. 2 shows another embodiment of the present invention where no temperature control at the combustion section by steam generation is conducted.

In FIG. 2, an apparatus 101 is a thermal cracking reactor, and an apparatus 100 is a regeneration reactor which comprises a gasification section 102 and a combustion section 103. An apparatus 104 is a cooler for cooling the product formed by the thermal cracking to separate it into liquid products and gas products.

Except for the features of this embodiment that the regeneration step is conducted in a single vessel and no temperature control at the combustion section by steam generation is conducted, this embodiment of FIG. 2 is substantially the same as that shown in FIG. 1 in the type and function of the elements shown, particulars of which will thus be given hereinbelow briefly.

100–104: See above.

105: Conduit for feeding steam or steam-containing gas for the thermal cracking.

106: Conduit for feeding heavy oil with or without steam.

107: Perforated plate.

108–110: Means for delivering the thermal cracking products.

111: Receiver for the liquid product, the oil.

112: Conduit for recovery of the gas product.

113–116: Means for withdrawing the fine particles having coke deposited thereon and for sending them to the regeneration reactor 100.

117: Conduit for feeding steam or steam-containing gas to the regeneration section 102.

118–120: Means for taking out the gas formed by the gasification at the gasification section 102.

112–124: Means for withdrawing a portion of the fine particles which have undergone the gasification treatment and sending them to the thermal cracking reactor 101.

125–128: Means for withdrawing the remaining of the fine particles which have undergone gasification treatment and send them to the combustion section 103.

129: Conduit for feeding oxygen-containing gas for the combustion section 103.

130–132: Means for recovery of the gas produced by the combustion.

It should be understood that provision of a cooling means with the combustion section, the coolant therefor being water which will generate steam, is optional and the description of the present invention should be read taking this in consideration.

EXPERIMENTAL EXAMPLES

EXAMPLE 1

(1) Experimental device:

The same device as shown in the FIG. 1 was employed. The thermal cracking reactor was cylindrically shaped with an inner diameter of 5.4 cm and a height of the fluidized-bed portion of 1.8 m, with the inlet pipe for feeding the feedstock oil being positioned at 0.6 m from the lower end, and 1.2 m upper than the inlet was primarily the thermal cracking reaction zone and about 0.6 m lower than the inlet is the stripping zone. In the stripping zone, 5 pieces of porous plates with a percentage perforation area relative to the horizontal cross-sectional area of the fluidizedbed of 20% were arranged at intervals of 0.1 m. The gasification reactor had an inner diameter of 8.1 cm and a height of the fluidized-bed portion of about 1 m, and the combustion reactor an inner diameter of 5.4 cm and a height of about 1.0 m, and had a heat transfer pipe with an inner diameter of 0.5 cm and a length of 0.1 m through which water could be passed. All the devices employed were made of stainless steel. p (2) Experimental conditions:

As the fluidized particles, 9 liters of fine particles of a porous material of the alumina type which was a material conventionally used as a fluidized-bed catalyst carrier were filled and about 4 liters/ hour were circulated between the thermal cracking reactor and the gasification reactor, and about one liter/hour between the gasification reactor and the combustion reactor. From the inlet pipe at the bottom of the thermal cracking reactor, 100 g/hour of steam pre-heated to 400° C. was fed, and 100 g/hour of steam pre-heated to about 400° C. was fed together with 585 g/hour of a heavy oil pre-heated to 300° C. from the inlet for feedstock oil. The fine particles on which coke had deposited discharged from the thermal cracking reactor were transported with nitrogen to the gasification reactor.

From the inlet pipe at the bottom of the gasification reactor, 60 g/hour of steam heated to about 400° C. and 90 liters/hour of oxygen of normal temperature were fed. Into the combustion reactor was fed 160 liters/hour of air of normal temperature, while 140 g/hour of water passed through the heat transfer tube. The fine particles overflown from the combustion reactor was circulated by nitrogen to the gasification reactor.

The temperature of the fluidized-bed in the thermal cracking reactor was adjusted constantly at 450° C., the temperature of the fluidized-bed in the gasification reactor at 780° C. and the temperature of the fluidized-bed in the combustion reactor at 850° C., respectively. The pressure employed was atmospheric.

The thermally cracked product was cooled with water and brine to normal temperature and the product oil was condensed together with water, followed by separation of the cracked gas.

The feedstock heavy oil was a vacuum residue, having the following properties:

Specific gravity =1.026, Heavy oil fraction (b.p. of 540° C. or higher)=93 wt.%, CCR=21.9 wt.%, Sulfur =5.9 wt.%.

The fine particles employed had the following properties:

Bulk density=0.39 g/cm$^3$, Pore volume=1.36 cm$^3$/g, Specific surface area=320 m$^2$/g, Average pore diameter =260Å, Weight average diameter=0.068 mm.

(3) Experimental results:

| | |
|---|---|
| Yield of product oil based on feedstock heavy oil | 69.5 wt. % |
| Composition of the product oil: | |
| Naphtha fraction (b.p. lower than 170° C.) | 15 wt. % |
| Kerosene fraction (b.p. 170° C.–340° C.) | 39 wt. % |
| Light oil fraction (b.p. 340–540° C.) | 43 wt. % |
| Heavy oil fraction (b.p. higher than 540° C.) | 3 wt. % |
| Total | 100 wt. % |
| Yield of the gas produced by the thermal cracking based on feedstock heavy oil | 5.5 wt. % |
| Gas produced by the gasification (dry) | 190 N liter/hour |
| Composition: | |
| $CO_2$ | 27 vol. % |
| CO | 57 vol. % |
| $H_2$ | 14 vol. % |
| $H_2S$, $N_2$ | 2 vol. % |
| | 100 vol. % |
| Gas produced by the combustion (dry) | 155 N liter/hour |
| Composition: | |
| $CO_2$ | 14 vol. % |
| $O_2$ | 6 vol. % |
| $N_2$ | 80 vol. % |
| | 100 vol. % |
| Amount of steam formed (about 110° C.) | 140 g/hour |

When a part of the circulated particles was sampled and measured for the carbon in the materials deposited thereon in a conventional manner, the following values were obtained.

| | |
|---|---|
| On the particles within the thermal cracking reactor | 15 wt. % |
| On the particles within the gasification reactor | 7 wt. % |
| On the particles within the combustion reactor | 3 wt. % |

EXAMPLE 2

(1) Experimental device:

The apparatus shown in FIG. 2 was used. The thermal cracking reactor was the same as that used in Example 1 in its structure and size. The regeneration reactor was cylindrically shaped comprising a gasification section of an inner diameter of 5.4 cm and of a height of ca. 1.0 m of a fluidized-bed portion, and a combustion section of an inner diameter of 8.1 cm and of a height of ca. 0.5 m of a fluidized-bed portion. All the devices utilized were made of stainless steel.

(2) Experimental conditions:

As the fluidized particles, about 8 liters of fine particles of porosity of the alumina type which was a material conventionally used as a fluidized-bed catalyst carrier were filled, and portions of the particles were recycled between the thermal cracking step and the gasification section and between the gasification section and the combustion section in about 3.5 lit/hr and about 20 lit/hr, respectively, 150 g/hr of steam preheated to about 400° C. was fed to the thermal cracking reactor from its bottom, and 585 g/hr of a heavy oil preheated to about 300° C. together with 100 g/hr of steam preheated to about 400° C. were fed to the thermal cracking reactor via a conduit for feeding the oil. Transportation of the fine particles from the thermal cracking reactor into the gasification section was conducted by the use of about 100 g/hr of steam preheated to about 400° C. injected.

To the gasification section of the regeneration reactor, 120 g/hr of steam preheated to about 400° C. was fed from its bottom. 670 lit/hr of air of about 50° C. was fed to the combustion section.

The temperatures of the fluidized-beds in the thermal cracking reactor, in the gasification reactor and in the combustion reactor were held at a constant level of 450° C., 780° C. and 890° C., respectively. The pressure employed was atmospheric.

The heavy oil used was the same as was used in Example 1.

(3) Experimental results:

| | |
|---|---|
| Yield of product oil based on feedstock heavy oil | 70.1 wt. % |
| Composition of the product oil: | |
| Naphtha fraction (b.p. lower than 170° C.) | 16 wt. % |
| Kerosene fraction (b.p. 170° C.–340° C.) | 36 wt. % |
| Light oil fraction (b.p. 340–540° C.) | 44 wt. % |
| Heavy oil fraction (b.p. higher than 540° C.) | 4 wt. % |
| Total | 100 wt. % |
| Gas produced by the thermal cracking | 50 N liter/hour |
| Composition | |
| $H_2$ | 58 vol. % |
| $CH_4$ | 16 vol. % |
| $C_2H_6$, $C_2H_4$ | 9 vol. % |
| $C_3H_8$, $C_3H_6$ | 8 vol. % |
| $H_2S$, $CO_2$, CO, $N_2$ | 9 vol. % |
| Total | 100 vol. % |
| Gas produced by the gasification (dry) | 190 N liter/hour |
| Composition: | |
| $CO_2$ | 13 vol. % |
| CO | 29 vol. % |
| $H_2$ | 56 vol. % |
| $H_2S$, $N_2$ | 2 vol. % |
| Total | 100 vol. % |
| Gas produced by the combustion (dry) | 740 N liter/hour |
| Composition | |
| $CO_2$ | 14 vol. % |
| CO | 10 vol. % |
| $N_2$ | 74 vol. % |
| Others | 2 vol. % |
| Total | 100 vol. % |

When a part of the circulated particles was sampled and measured for the carbon in the materials deposited thereon in a conventional manner, the following values were obtained.

| | |
|---|---|
| On the particles within the thermal cracking reactor | 11 wt. % |
| On the particles within the gasification reactor | 4 wt. % |
| On the particles within the combustion | 3 wt. % |

-continued

| |
|---|
| reactor |

EXAMPLE 3

An experiment was conducted which was substantially the same as that set forth in Example 2 except for the following:

(1) 35 liters/hr of pure oxygen was added together with the steam to the gasification section;

(2) 490 liter/hr, instead of 670 liter/hr, of air was fed to the combustion section; and (3) about 15 liters/hr, instead of about 20 liters/hr, of the fine particles was circulated from the gasification section to the combustion section.

The result obtained in the thermal cracking step remained substantially the same, and 565 liter/hr of gas was obtained at the combustion section, the composition of the gas remaining substantially the same.

The particulars of the gas formed at the gasification section are as follows.

| | | |
|---|---|---|
| Quantity: | | 230 liter/hr. |
| Composition: | | |
| $CO_2$ | | 19 vol. % |
| CO | | 35 vol. % |
| $H_2$ | | 44 vol. % |
| $H_2S$, $N_2$ | | 2 vol. % |
| | Total | 100 vol. % |

What is claimed as new and desired to be secured by Letters Patent of the United States is:

1. In a process for thermal cracking of a heavy hydrocarbon oil, comprising (a) a thermal cracking step for thermally cracking a heavy hydrocarbon oil by contacting the heavy hydrocarbon oil with fine particles of a porous material fluidized by a steam-containing gas and (b) a regeneraton step for regenerating the fine particles withdrawn from the thermal cracking step by combustion or gasification of a coke deposited on the fine particles with a molecular oxygen-containing gas or a steam-containing gas, while the fine particles are being fluidized, said steps being practiced while the fine particles are circulated between the both steps, the improvement which comprises carrying out these steps under the following conditions in combination:

(1) said fine particles are fine particles of a porous material constituted essentially of fine spherical particles having a pore volume of 0.2 to 1.5 $cm^2/g$, a specific surface area of 5 to 1,500 $m^2/g$, an average pore diameter of 10 to 10,000 U and a weight average particle diameter of 0.025 to 0.25 mm, these properties being stable at the temperature employed;

(2) said regeneraton step comprises a combustion section and a gasification section from which the gases generated in the respective sections can be taken out separately and between which said fine particles are circulated;

(3) the temperature of the combustion section is controlled by controlling the amount of steam generated in a cooling means which is installed in the combustion section in the regeneration step and whose coolant is waterthat is to generate the steam;

(4) at least 70% by weight of said fine particles circulated between the thermal cracking step and the regeneration step is circulated between the thermal cracking step and the gasification section in the regeneration step;

(5) the amount of said fine particles circulated between the combustion section and the gasification section in the regeneration step is at least 20-fold weight of the CCR of the heavy oil fed;

(6) said fine particles contact a molecular oxygen-containing gas at the combustion section in the regeneraton step whereby a part of the coke deposited is combusted, whereby the temperature of said fine particles is higher by at least 50° C. than the temperature in the gasification section;

(7) said fine particles contact a steam-containing gas at the gasification section in the regeneration step thereby gasifying a part of the coke deposited thereon, whereby the temperature of said fine particles is higher by at least 100° C. than the temperature in the thermal cracking step; and, (8) said thermal cracking step is conducted at a temperature of about 350° to 600° C.

2. A process according to claim 1, wherein the steam-containing gas at the gasification section in the regeneration step is a steam to which oxygen and/or air is added.

3. A process according to claim 1 or claim 2, wherein the molecular oxygen-containing gas at the combustion section in the regeneration step is air.

4. A process according to claim 1, wherein the part of the coke deposited on said fine particles is combusted while said fine particles are fluidized in the combustion section in the regeneration step by the oxygen-containing gas of the ascending speed of the gaseous components of 200 cm/sec. as a superficial velocity.

5. A process according to claim 1, wherein the steam generated through the cooling means at the combustion section in the regeneration step is used for at least a part of the fluidizing gas at the gasification section in the regeneration step and/or in the thermal cracking step.

6. In a process for thermal cracking of a heavy hydrocarbon oil, comprising (a) a thermal cracking step for thermally cracking a heavy hydrocarbon oil by contacting the heavy hydrocarbon oil with fine particles of a porous material fluidized by a steam-containing gas and (b) a regeneration step for regenerating the fine particles withdrawn from the thermal cracking step by combustion or gasification of a coke deposited on the fine particles with a molecular oxygencontaining gas or a steam-containing gas, while the fine particles are being fluidized, said steps being practiced while the fine particles are circulated between the both steps, the improvement which comprises carrying out these steps under the following conditions:

(1) said fine particles are fine particles of a porous material constituted essentially of fine spherical particles having a pore volume of 0.2 to 1.5 $cm^3/g$, a specific surface area of 5 to 1,500 $m^2/g$, an average pore diameter of 10 to 10,000 Å and a weight average particle diameter of 0.025 to 0.25 mm, these properties being stable at the temperature employed;

(2) said regeneration step comprises a combustion section and a gasification section from which the gases generated in the respective sections can be taken out separately and between which said fine particles are circulated;

(3) at least 70% by weight of said fine particles circulated between the thermal cracking step and the regeneration step is circulated between the thermal cracking step and the gasification section in the regeneration step;

(4) the amount of said fine particles circulated between the combustion section and the gasification section in the regeneration step is at least 20-fold weight of the CCR of the heavy oil fed;

(5) said fine particles contact a molecular oxygen-containing gas at the combustion section in the regeneration step whereby a part of the coke deposited is combusted, whereby the temperature of said fine particles is higher by at least 50° C. than the temperature in the gasification section;

(6) said fine particles contact a steam-containing gas at the gasification section in the regeneration step thereby gasifying a part of the coke deposited thereon, whereby the temperature of said fine particles is higher by at least 100° C. than the temperature in the thermal cracking step.

7. A process according to claim 6, wherein the steam-containing gas at the gasification section in the regeneration step is a steam to which oxygen and/or air is added.

8. A process according to claim 6, wherein the molecular oxygen-containing gas at the combustion section in the regeneration step is air.

9. A process according to claim 6, wherein the part of the coke deposited on said fine particles is combusted while said fine particles are fluidized in the combustion section in the regeneration step by the oxygen-containing gas of the ascending speed of the gaseous components of 200 cm/sec. as a superficial velocity.

10. A process according to claim 1, wherein the pore volume of the fine particles sent from the regeneration step to the thermal cracking step and the fine particles which may be added thereto is not smaller than the volume of the heavy hydrocarbon oil fed.

* * * * *